US007199566B2

(12) United States Patent
Suzuki

(10) Patent No.: US 7,199,566 B2
(45) Date of Patent: Apr. 3, 2007

(54) VOLTAGE REGULATOR

(75) Inventor: Teruo Suzuki, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/172,682

(22) Filed: Jul. 1, 2005

(65) Prior Publication Data

US 2006/0001407 A1 Jan. 5, 2006

(30) Foreign Application Priority Data

Jul. 5, 2004 (JP) ..... 2004-198546

(51) Int. Cl.
*G05F 1/573* (2006.01)
*G05F 1/00* (2006.01)

(52) U.S. Cl. ..... 323/274; 323/276; 323/277

(58) Field of Classification Search ..... 323/272, 323/274, 276, 277, 273
See application file for complete search history.

(56) References Cited

U.S. PATENT DOCUMENTS 5,861,736 A * 1/1999 Corsi et al. ..... 323/273
6,690,147 B2 * 2/2004 Bonto ..... 323/280
6,700,360 B2 * 3/2004 Biagi et al. ..... 323/280
6,825,642 B2 * 11/2004 Brooks ..... 323/272

* cited by examiner

*Primary Examiner*—Bao Q. Vu
(74) *Attorney, Agent, or Firm*—Adams & Wilks

(57) ABSTRACT

A voltage regulator has an output transistor connected between a power supply and an output terminal, and a voltage amplifying circuit that compares a feedback voltage with a reference voltage to control the output transistor. A transient response improving circuit has a detecting portion that detects fluctuations in the power supply voltage and controls the operating current of the voltage amplifying circuit based on the detected fluctuation level of the power supply voltage thereby improving the responsiveness and reducing power consumption of the voltage regulator.

3 Claims, 2 Drawing Sheets

VOLTAGE REGULATOR

BACKGROUND OF THE INVENTION

1. Field of the Invention

The present invention relates to a voltage regulator which is excellent in responsiveness with low power consumption.

2. Description of the Related Art

FIG. 3 shows a circuit diagram of a conventional voltage regulator. A reference voltage circuit 20 outputs a reference voltage Vref. A feedback voltage VFB which is obtained by dividing an output voltage Vout at an output terminal through a resistor 50 and a resistor 60 is outputted from a node between the resistor 50 and the resistor 60. A voltage amplifying circuit 30 controls a PMOS transistor 40 based on results of comparison between the feedback voltage VFB and the reference voltage Vref so that the output voltage Vout becomes constant (refer to JP 2001-282371 A for example).

However, in such a conventional voltage regulator, in order to obtain the stable output voltage Vout against power supply fluctuation, it is necessary to increase a current consumed in the voltage amplifying circuit 30, and thus a large current is usually caused to flow through the voltage amplifying circuit 30 irrespective of a fluctuation level in a power supply voltage.

SUMMARY OF THE INVENTION

The present invention has been made in order to solve the above-mentioned problem associated with the related art, and it is, therefore, an object of the present invention to provide a voltage regulator which is excellent in responsiveness with low power consumption.

A transient response improving circuit of a voltage regulator according to the present invention is provided with a detection portion for detecting a power supply voltage. Thus, the above-mentioned problem is solved by controlling an operating current of a voltage amplifying circuit in correspondence to a fluctuation level in a power supply voltage. As a result, the voltage regulator is provided which is excellent in responsiveness with low power consumption.

According to the present invention, the operating current of the voltage amplifying circuit is controlled based on results of detection of the fluctuation level in the power supply voltage. As a result, during a normal operation in which there is no fluctuation in the power supply voltage, power consumption becomes small, while during a transient response in which the power supply voltage fluctuates, power consumption is increased to improve the responsiveness. Consequently, it is possible to provide the voltage regulator which is excellent in responsiveness with low power consumption.

DETAILED DESCRIPTION OF THE PREFERRED EMBODIMENTS

Figure 1:
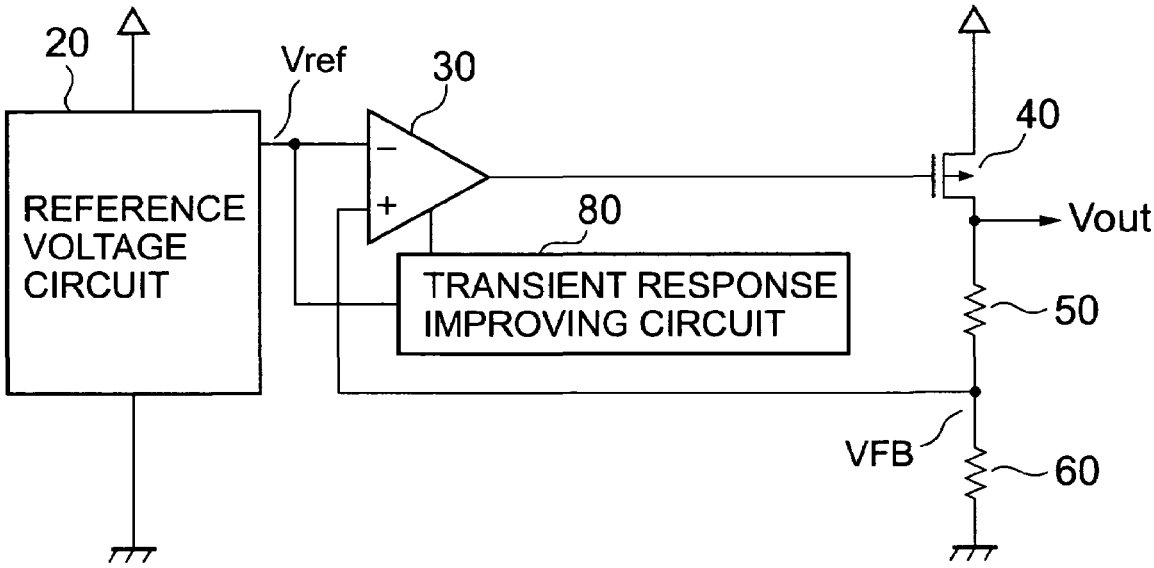
FIG. 1 is a block diagram of a voltage regulator circuit according to an embodiment of the present invention.

FIG. 1 is a block diagram of a voltage regulator circuit according to an embodiment of the present invention. A reference voltage circuit 20 outputs a reference voltage Vref. A feedback voltage VFB which is obtained by dividing an output voltage Vout at an output terminal through a resistor 50 and a resistor 60 is outputted from a node between the resistor 50 and the resistor 60. A voltage amplifying circuit 30 controls a PMOS transistor 40 based on results of comparison between the feedback voltage VFB and the reference voltage Vref so that the output voltage Vout becomes constant. A transient response improving circuit 80 receives as its inputs the reference voltage Vref and a power supply voltage and outputs a signal used to control an operating current of the voltage amplifying circuit 30.

Figure 2:
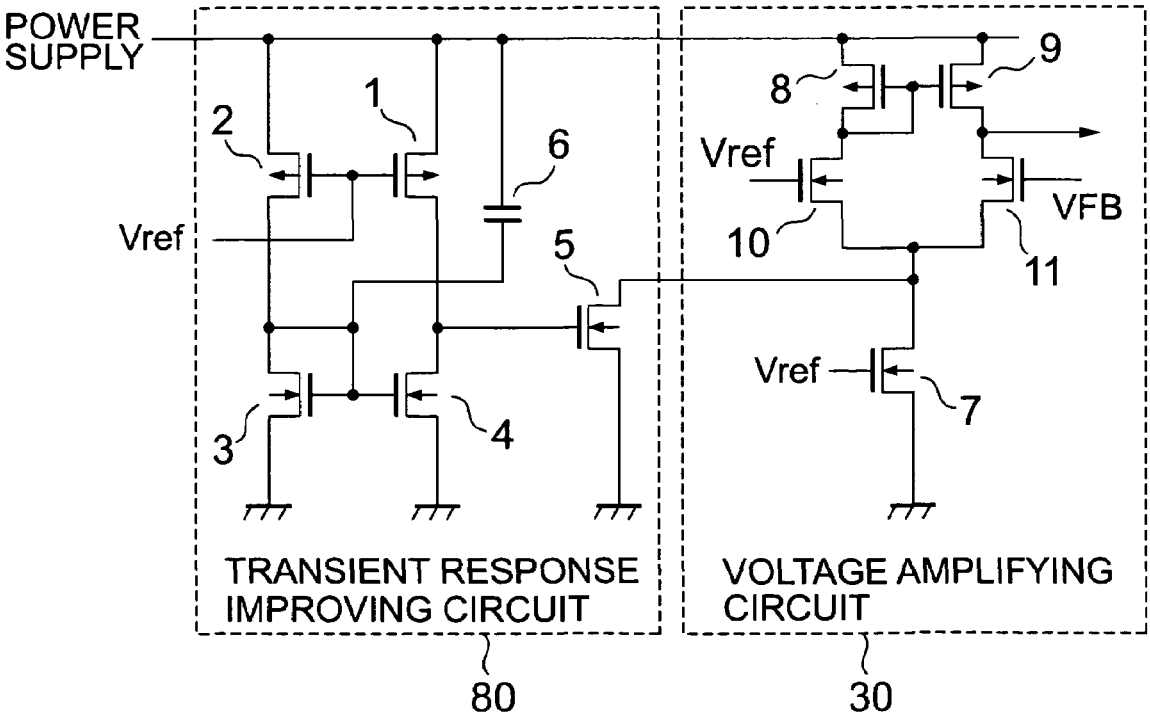
FIG. 2 is a circuit diagram of a transient response improving circuit and a voltage amplifying circuit in the voltage regulator circuit according to the embodiment of the present invention.
Figure 3:
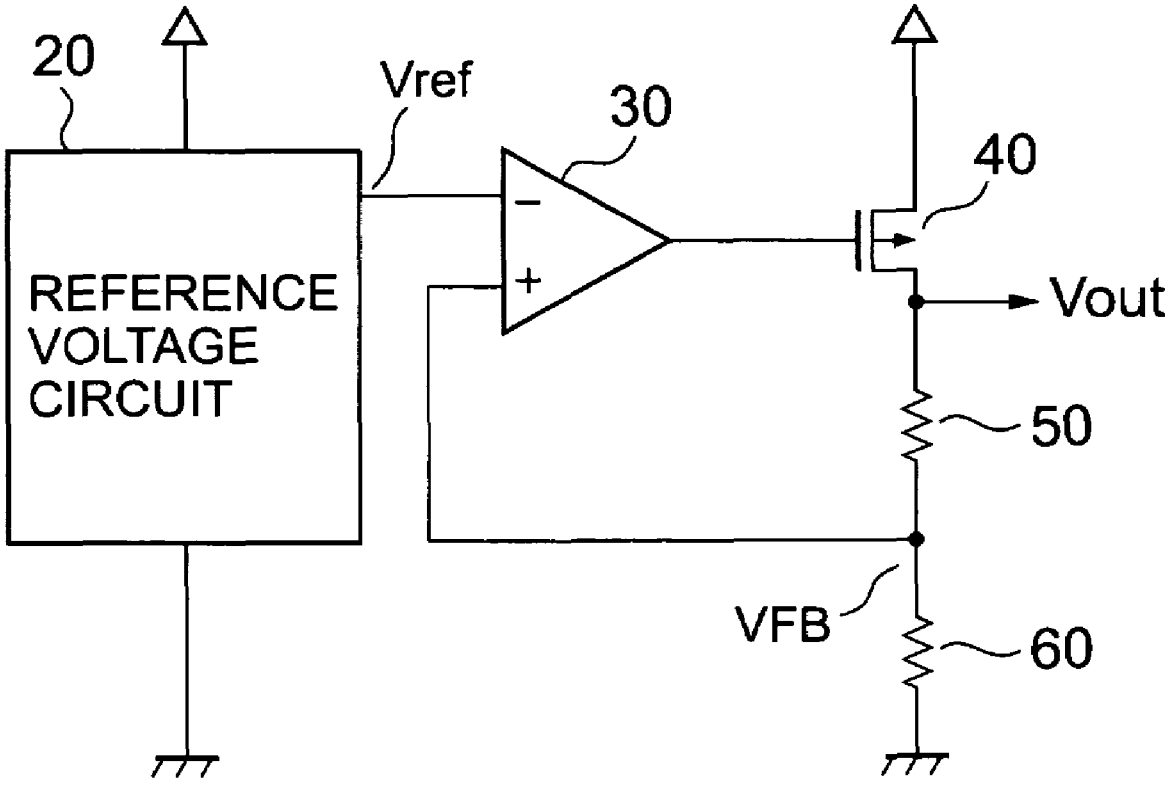
FIG. 3 PRIOR ART
FIG. 3 is a block diagram of a conventional voltage regulator circuit.

FIG. 2 is a circuit diagram of a transient response improving circuit and a voltage amplifying circuit of the present invention. The transient response improving circuit 80 includes a constant current portion, a detection portion for detecting a fluctuation level in the power supply voltage, and an output portion. The transient response improving circuit 80 serves to detect a fluctuation level in the power supply voltage in order to control a current caused to flow through the voltage amplifying circuit 30.

The constant current portion is a current mirror circuit constituted by PMOS transistors 1 and 2. The current mirror circuit causes a predetermined constant current to flow based on the reference voltage Vref which is applied to gate electrodes of the PMOS transistors 1 and 2, respectively. The detection portion for detecting a fluctuation level in the power supply voltage is constituted by NMOS transistors 3 and 4 having respective gate electrodes connected to each other through a node. A capacitor 6 for monitoring the power supply voltage is connected to the node. The output portion is constituted by an NMOS transistor 5 a gate of which is controlled by a drain voltage of the NMOS transistor 4.

The voltage amplifying circuit 30 includes a constant current circuit and a differential amplifying circuit. The constant current circuit is constituted by an NMOS transistor 7 to a gate of which the reference voltage is applied, and serves to cause a predetermined constant current to flow through the differential amplifying circuit. The differential amplifying circuit includes a current mirror circuit constituted by PMOS transistors 8 and 9, and a differential pair constituted by NMOS transistors 10 and 11. The reference voltage is applied to a gate of the NMOS transistor 10 and the feedback voltage VFB, as shown in FIG. 1, is applied to a gate of the NMOS transistor 11. A voltage signal indicating results of comparison between a gate voltage of the NMOS transistor 10 and a gate voltage of the NMOS transistor 1 is outputted to a gate of the PMOS transistor 40 shown in FIG. 1.

Also, the NMOS transistor 5 of the transient response improving circuit 80 is connected in parallel with the NMOS transistor 7 of the voltage amplifying circuit 30.

Hereinafter, a description will be given with respect to an operation of the transient response improving circuit 80 of the present invention.

Firstly, when there is no fluctuation in the power supply voltage, the NMOS transistors 3 and 4 of the detection portion are in an ON state, and thus a constant current is caused to flow through the NNOS transistors 3 and 4, respectively, from the constant current portion. Since a source of the NMOS transistor 4 is grounded, a drain voltage of the NMOS transistor 4 at this time is lower than a threshold of the NMOS transistor 5 and thus the NMOS transistor 5 is an OFF state. As shown in FIG. 2, a drain of the NMOS transistor 5 is connected in parallel with the constant current source or circuit 7 of the voltage amplifying circuit 30. However, since the NMOS transistor 5 is in the OFF state, no current is caused to flow through the NMOS transistor 5.

Next, when the power supply voltage fluctuates, electric charges corresponding to the power supply voltage and the common gate voltage of the NMOS transistors 3 and 4 are accumulated in the capacitor 6. When the power supply voltage drops, the common gate voltage of the NMOS transistors 3 and 4 also drops in correspondence to an electric potential of the power supply voltage. When the common gate voltage of the NMOS transistors 3 and 4 becomes low, the NMOS transistors 3 and 4 are turned OFF accordingly. Since the drain voltage of the NMOS transistor 4 increases, the NMOS transistor 5 is turned ON and thus a current is caused to flow through the NMOS transistor 5 in correspondence to the voltage reduction level detected.

The drain of the NMOS transistor 5 is connected in parallel with the voltage amplifying circuit 30. Hence, in the voltage amplifying circuit 30, the current increases in correspondence to the voltage reduction level detected, and thus the transient response of the voltage amplifying circuit 30 is improved.

When the NMOS transistor 4 is constituted by an NMOS transistor having a threshold of 0.3 V, and the NMOS transistor 3 is constituted by an NMOS transistor having a threshold of 0.6 V, a common gate potential of the NMOS transistors 3 and 4 becomes equal to or higher than 0.6 V. In this case, in order to turn OFF the NMOS transistor 4, 0.3 V or more is required as the fluctuation level in the power supply voltage. This reason is that when the fluctuation level in the power supply voltage is small, the fluctuation level in the output voltage is small accordingly. It is therefore unnecessary to take measures to cope with such a situation. In addition, the threshold voltages described above are merely an example, and thus the threshold voltage can be set in correspondence to a detection level in the power supply voltage.

As set forth hereinabove, the output transistor of the transient response improving circuit is connected in parallel with the constant current source of the voltage amplifying circuit. In this state, during the normal operation, the operating current is reduced, while only during the transient response operation, the operating current is increased. As a result, it is possible to provide the voltage regulator which is excellent in transient response with low power consumption.

What is claimed is:

1. A voltage regulator comprising:

an output transistor connected between a power supply and an output terminal;

a feedback resistor for feeding back as a feedback voltage an output voltage at the output terminal;

a reference voltage circuit for outputting a reference voltage;

a voltage amplifying circuit for comparing the feedback voltage outputted from the feedback resistor with the reference voltage to control the output transistor; and a transient response improving circuit which comprises a constant current portion for causing a predetermined current to flow based on the reference voltage;

a detection portion for detecting a fluctuation in the power supply voltage; and an output portion for supplying a current corresponding to a fluctuation level detected by the detection portion to the voltage amplifying circuit.

2. A voltage regulator according to claim 1, wherein the detection portion comprises a first NMOS transistor and a second NMOS transistor which are connected to each other to form a current mirror circuit; and a capacitor provided between a node between a gate of the first NMOS transistor and a gate of the second NMOS transistor, and the power supply, so that the detection portion detects the voltage of the power supply based on reduction in electric potential at the gates through the capacitor.

3. A voltage regulator according to claim 2, wherein a threshold voltage of the second NMOS transistor is lower than that of the first NMOS transistor.

* * * * *